US012286770B2

(12) United States Patent
Valeck et al.

(10) Patent No.: US 12,286,770 B2
(45) Date of Patent: Apr. 29, 2025

(54) MOTOR GRADER APPLICATION SEGMENTATION FOR LEVER CONTROL

(71) Applicant: Caterpillar Inc., Peoria, IL (US)

(72) Inventors: Jeremy G Valeck, Mt Zion, IL (US); John B. Hessling, III, Marquette Heights, IL (US)

(73) Assignee: Caterpillar Inc., Peoria, IL (US)

( * ) Notice: Subject to any disclaimer, the term of this patent is extended or adjusted under 35 U.S.C. 154(b) by 725 days.

(21) Appl. No.: 17/328,430

(22) Filed: May 24, 2021

(65) Prior Publication Data

US 2022/0372734 A1 Nov. 24, 2022

(51) Int. Cl.
*E02F 9/26* (2006.01)
*E02F 3/76* (2006.01)
*E02F 9/22* (2006.01)

(52) U.S. Cl.
CPC ..... *E02F 9/264* (2013.01); *E02F 3/7604* (2013.01); *E02F 9/2221* (2013.01)

(58) Field of Classification Search
CPC ..... E02F 3/7645; E02F 3/764; E02F 3/844; E02F 9/2054; E02F 3/961; E02F 9/264; E02F 3/7604; E02F 9/2221
See application file for complete search history.

(56) References Cited

U.S. PATENT DOCUMENTS 7,689,394 B2 3/2010 Furem et al.
8,596,373 B2 * 12/2013 Montgomery ..... E02F 3/847 172/4.5
9,164,508 B1 * 10/2015 Takach, Jr. ..... G05D 1/0011
9,982,414 B2 5/2018 Jang
10,030,366 B2 * 7/2018 Tevis ..... E02F 3/7654
2007/0284121 A1 * 12/2007 Montgomery ..... E02F 3/847 172/2
2014/0067092 A1 3/2014 Cesur et al.
2016/0076226 A1 * 3/2016 Edara ..... G07C 5/0841 701/25
2016/0098637 A1 4/2016 Hodel et al.
2019/0100899 A1 * 4/2019 Kimura ..... E02F 9/22
2019/0382983 A1 * 12/2019 Gentle ..... E02F 9/2025
(Continued)

FOREIGN PATENT DOCUMENTS

JP 5937499 5/2016
WO 2019181685 9/2019

*Primary Examiner* — Aniss Chad
*Assistant Examiner* — Christopher George Fees

(57) ABSTRACT

A lever-operated motor grader can include a front end including a pair of steerable tires connected to the front end; a rear end pivotally connected to the front end at an articulation joint, the rear end including a power source operatively coupled to at least two driven tires; a drawbar-circle-moldboard assembly having a blade, the drawbar-circle-moldboard assembly configured for moving the blade into various orientations, the blade movement controlled by a hydraulic system coupled to one or more operator-controlled levers of the motor grader; a controller; and a pressure sensor coupled to the hydraulic system of the blade to deliver to the controller a signal corresponding to a pressure of the hydraulic system; wherein the controller receives the signal corresponding to the pressure of the hydraulic system, and wherein the controller is configured to determine an application of the motor grader based on the received signal.

20 Claims, 3 Drawing Sheets

(56) References Cited

U.S. PATENT DOCUMENTS

| | | | | |
|---|---|---|---|---|
| 2020/0102718 | A1* | 4/2020 | Cline | E02F 3/765 |
| 2020/0123735 | A1* | 4/2020 | Stotlar | E02F 3/841 |
| 2020/0270847 | A1* | 8/2020 | Kean | E02F 3/844 |
| 2020/0362542 | A1* | 11/2020 | Veasy | E02F 3/765 |
| 2021/0047807 | A1* | 2/2021 | Gray | E02F 9/264 |
| 2022/0403625 | A1* | 12/2022 | Jelinek | E02F 9/265 |

* cited by examiner

MOTOR GRADER APPLICATION SEGMENTATION FOR LEVER CONTROL

TECHNICAL FIELD

The present disclosure generally relates to a work machine. More particularly, the present disclosure relates to a system and method of application segmentation for a motor grader.

BACKGROUND

Motor graders can be used to prepare the grade of a ground surface in an area. Motor graders are used primarily as a finishing tool to sculpt a surface of a construction site to a final shape and contour. Some motor graders include hand-operated lever controls to position a blade of the grader. The blade is adjustably mounted to the front frame to move quantities of earth from side to side.

For lever-controlled motor graders, it has been a challenge to track machine utilization. Owners and operators of lever-controlled motor graders desire to accurately track machine utilization. This can reduce unnecessary idle time as well as allow better machine planning to fully utilize existing fleets of machines.

US Patent Pub. 2016/0098637 discusses a system using sensors for classifying predictive operations of a work machine.

SUMMARY

In an example according to this disclosure, a lever-operated motor grader can include a front end including a pair of steerable tires connected to the front end; a rear end pivotally connected to the front end at an articulation joint, the rear end including a power source operatively coupled to at least two driven tires; a drawbar-circle-moldboard assembly having a blade, the drawbar-circle-moldboard assembly configured for moving the blade into various orientations, the blade movement controlled by a hydraulic system coupled to one or more operator-controlled levers of the motor grader; a controller; and a pressure sensor coupled to the hydraulic system of the blade to deliver to the controller a signal corresponding to a pressure of the hydraulic system; wherein the controller receives the signal corresponding to the pressure of the hydraulic system, and wherein the controller is configured to determine an application of the motor grader based on the received signal.

In one example according to the present disclosure, a method of identifying an application of a lever-operated motor grader can include sending pressure information from a pressure sensor coupled to a hydraulic system of a lever-operated blade to a controller; and the controller determining an application of the motor grader based on the received pressure information.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
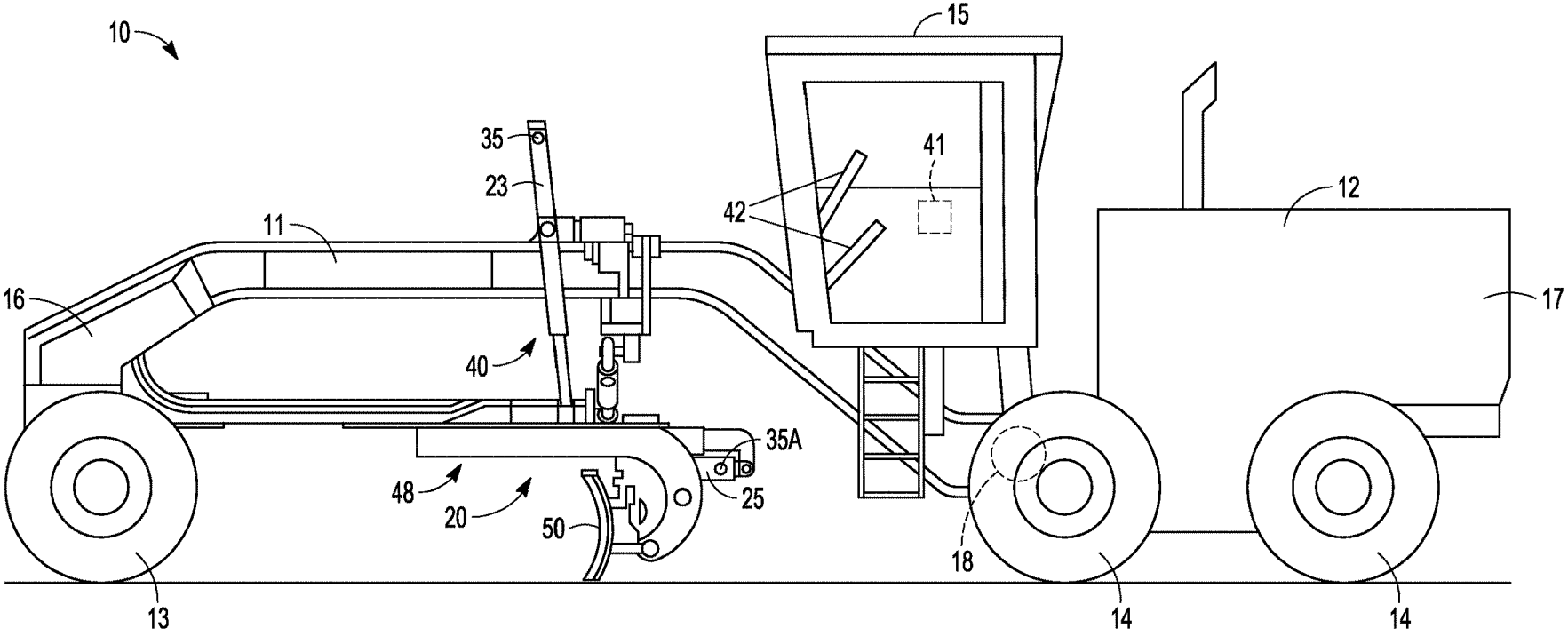
FIG. 1 shows a side view of a motor grader, in accordance with one embodiment.

FIG. 1 shows a side view of a lever-operated motor grader 10, in accordance with one embodiment. The lever-operated motor grader 10 generally includes a frame 11 and a power source such as an engine 12. A set of steerable front tires 13 may be operatively connected to the frame 11 generally adjacent a front end 16 of the motor grader 10 and two sets of rear tires 14 may be operatively connected to the frame 11 generally adjacent a rear end 17 of the motor grader 10. The rear end 17 of the frame 11 is pivotally coupled to the front end 16 at an articulation joint 18. In one embodiment, only a single set of rear tires 14 may be provided. One or both sets of rear tires 14 may be powered by a power transfer mechanism operatively connected to the engine 12. An operator cab 15 may be mounted on the frame 11 and includes various levers 42, controls, sensors and other mechanisms used by an operator.

The motor grader 10 can include a drawbar-circle-moldboard assembly (DCM) 20 having a blade 50. The DCM 20 can include a drawbar member supported by the frame 11. A rotatable circle assembly 48 can be connected to the drawbar member. The blade 50 can be supported by the rotatable circle assembly 48. A hydraulic system 40 including one or more hydraulic cylinders can be provided for controlling the position of the blade 50. For example, the circle assembly 48 can be supported by a pair of blade lift hydraulic cylinders 23 (with only one visible in FIG. 1). Adjustment of the blade lift cylinders 23 allows the height of rotatable circle assembly 48, and hence the height of blade 50, to be adjusted.

Blade lift cylinders 23 may be moved independently or in combination with each other. One or more center shift cylinders may be provided to shift the circle assembly 48 from side-to-side. A blade tilt hydraulic cylinder 25 can be provided to control the pitch, or angle between an edge of the blade 50 and the ground. One or more side-shift cylinders (not shown) can also be provided to control lateral movement of the blade 50 relative to the circle assembly 48.

In various examples, the DCM 20 can be configured for horizontal movement transverse to a longitudinal axis of the front end 16, and configured for vertical movement, such that the blade 50 can be operatively connected for rotational, horizontal, vertical, and pitch movement as part of the drawbar-circle-moldboard assembly 20.

Accordingly, the DCM 20 can be configured to move the blade 50 into various orientations. In this example, the blade movement can be controlled by the hydraulic system 40 including the blade lift hydraulic cylinder 23 coupled to one or more operator-control led levers 42 of the motor grader 10. The actuation of the blade lift cylinders 23 is done using the one or more levers 42 in the operator cab 15.

The levers 42 are directly connected to the hydraulic system 40 such that information or other data regarding the movement of the levers 42 is not recognized or noted by a controller 42. Accordingly, for lever-controlled motor graders it can be difficult to track machine utilization.

In the present system, there can be one or more hydraulic pressure sensors 35, 35A coupled to the hydraulic system 40 controlling the blade 50 to deliver a signal corresponding to a pressure of portions of the hydraulic system 40 to the controller 41. Since the levers 42 directly operate the hydraulic system 40 it can be difficult to determine whether the blade 50 is up or down because the controller 42 does not receive that information directly. Here, the hydraulic pressure sensor 35 can be operatively coupled to the blade lift hydraulic cylinder 23 and informs the controller 41 of the pressure at the hydraulic cylinder 23 and allows the controller 41 to determine whether the blade 50 is up or down depending on the pressure of the blade lift hydraulic cylinder 23.

Accordingly, the controller 41 receives the signal regarding the pressure information, and the controller 41 is configured to determine an application of the motor grader 10 based on the received pressure information. This can allow machine owners and operators to easily track when and where their machines have been working. Moreover, the controller 41 can use the sensor 35, 35A inputs along with standard machine data (such as machine speed, location, idle status) to better predict and output, in near real time, the motor grader application.

In one example, a pressure sensor 35A can be added to the blade tilt hydraulic cylinder 25 to determine tilt if desired. As will be described below, other sensors can also be added to the machine to help determine machine application.

In one example, the controller 41 can be configured to send the information regarding the application of the motor grader 10 to an external site. For example, the information can be networked to an external location so that a fleet of motor graders 10 can be monitored and a fleet supervisor can determine the best utilization of each motor grader in the fleet.

Figure 2:
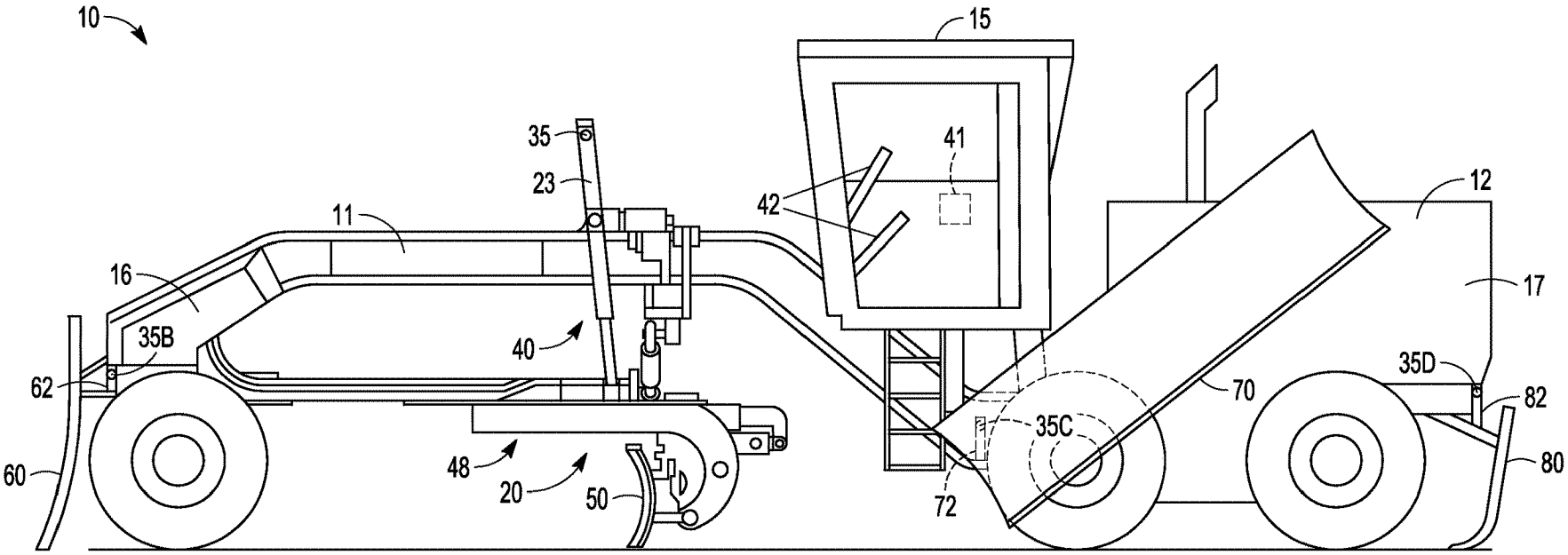
FIG. 2 shows a side view of a motor grader, in accordance with one embodiment.

Motor graders can also include many optional auxiliary tools. FIG. 2 shows a side view of the motor grader 10 with some added work tools. The lever-operated motor grader 10 can include one or more of a plurality of auxiliary work tools which are controllable by an operator of the motor grader 10 via the one or more levers 41.

For example, one of the auxiliary work tools can include a front blade 60 that is lever-operated and coupled to a front blade hydraulic system 62 and a front blade pressure sensor 35B can be coupled to the hydraulic system 62 of the front blade and to the controller 41. Based on a signal, corresponding to the pressure information, received from the pressure sensor 35B, the controller 41 can be configured to determine an orientation of the front blade 60 and to determine a utilization or application of the front blade 60.

In another example, one of the auxiliary work tools can include a snow wing 70 that is lever-operated and coupled to a snow wing hydraulic system 72 and a snow wing pressure sensor 35C is coupled to the hydraulic system 72 of the snow wing 70 and to the controller 41, and wherein the controller 41 is configured to determine an orientation of the snow wing and to determine a utilization and application of the snow wing 70 based on the pressure.

In another example, one of the auxiliary work tools can include a ripper mechanism 80 that is lever operated. In one example, the ripper mechanism can be moved by a ripper mechanism hydraulic system 82 and a rotary sensor 35D can be coupled to the ripper mechanism 80 and to the controller 41. Based on the rotary angle of the riper mechanism 80, the controller is configured to determine an orientation of the ripper mechanism 80 and to determine a utilization and application of the ripper mechanism 80.

Figure 3:
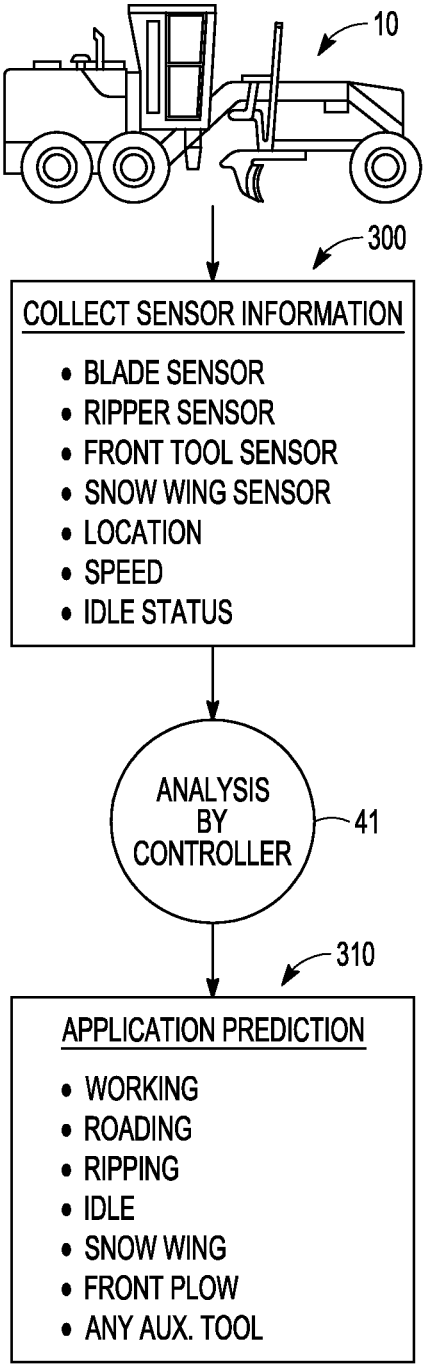
FIG. 3 shows a schematic of a control system for a motor grader, in accordance with one embodiment.

FIG. 3 shows a schematic of a control system for the lever-operated motor grader 10, in accordance with one embodiment.

As noted above, in operation the controller 41 also receives other machine state information. For example, the controller 41 can receive engine speed information, road speed information, idle status, and/or machine location from a GPS. This information along with the sensor information described above can be utilized to determine machine application. For example, FIG. 3 shows a process that can be utilized by the controller 41. The motor grader 10 can be configured to send various machine data to the controller 41, such as shown in step 300 where the controller 41 can receive one or more of blade sensor data, ripper sensor data, front tool data, snow wing data, along with machine location, machine speed, and idle status.

The controller 41 can be configured to analyze this data to predict machine application. For example, step 310 describes various application predictions possible by the controller 41. For example, whether the motor grader is working (blade is down), roading (traveling), ripping, idling, using the snow wing, using the front plow, or using any other auxiliary tool.

Thus, the controller 41 can make a classification of an operation of the motor grader to determine the type of work and including whether the motor grader is utilizing a snow wing, a front plow, or scarifying.

As noted above, each of the one or more auxiliary work tools are activated via a hydraulics system and a pressure sensor or rotary sensor can be associated with each of the one or more auxiliary work tools and configured to send the sensed information to the controller and the controller is configured to determine the one or more motor grader application based on the received information.

INDUSTRIAL APPLICABILITY

The present system can be applicable to a work machine such as a lever-operated motor grader. The present system provides an improved solution that can efficiently and accurately track the machine utilization in such motor graders and reduces the unnecessary idle time as well as future machine planning to fully utilize existing fleets of machines. As discussed above, for lever-controlled motor graders it has been a challenge to track machine utilization. Owners and operators of lever-controlled motor graders desire to accurately track machine utilization. The present system is capable of predicting applications that have previously been unable to be accurately tracked on lever-operated machines, including, but not limited to, such motor graders.

Figure 4:
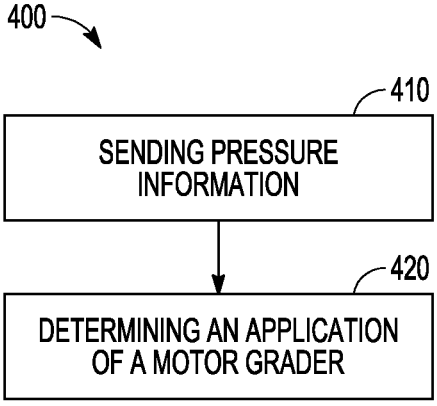
FIG. 4 shows a method of determining an application of a motor grader, in accordance with one embodiment.

FIG. 4 shows a method (400) of determining an application of a motor grader, in accordance with one embodiment.

The method (400) can include sending pressure information (410) from a pressure sensor coupled to a hydraulic system of a lever-operated blade, or other work tool, to a controller, and thereafter the controller determining an application of the motor grader (420) based on the received pressure information.

In various embodiments of the method, optional details as discussed above can be implemented. For example, the method can include determining whether one or more of a plurality of auxiliary work tools of the motor grader are being applied. For example, if the motor grader includes a front blade, or a snow wing, or a ripper, the method can include determining the application.

As discussed, the method can include sending the information to an external site. The information can be displayed on computer screens or output displays, whether monitors or mobile devices such as tablets, laptops, or smartphones, and whether located in the motor grader, on the job site, or at a remote location such as a central office.

In summary, the present system, as discussed above, provides a system to accurately track the machine utilization in lever-operated motor graders, and other such work machines, and reduces the unnecessary idle time as well as aids future machine planning to fully utilize existing fleets of machines.

The above detailed description is intended to be illustrative, and not restrictive. The scope of the invention should, therefore, be determined only with references to the appended claims, along with the full scope of equivalents to which such claims are entitled.

What is claimed is:

1. A lever-operated motor grader, comprising:

a front end including a pair of steerable tires connected to the front end;

a rear end pivotally connected to the front end at an articulation joint, the rear end including a power source operatively coupled to at least two driven tires;

a drawbar-circle-moldboard assembly having a blade, the drawbar-circle-moldboard assembly configured for moving the blade into various orientations, the blade movement controlled by a hydraulic system coupled to one or more operator-controlled levers of the motor grader, wherein the operator-controlled levers are directly connected to the hydraulic system and not a controller such that movement of the levers or any other operator input is not recognized by the controller of the motor grader;

the controller; and a pressure sensor coupled to the hydraulic system of the blade to deliver to the controller a signal corresponding to a pressure of the hydraulic system, wherein the pressure sensor includes a hydraulic pressure sensor coupled to a blade lift cylinder of the hydraulic system;

wherein the controller receives the signal corresponding to the hydraulic pressure of the blade lift cylinder of the hydraulic system, and wherein the controller is configured to determine an application of the motor grader based on the received hydraulic pressure signal from the blade lift cylinder by determining from the hydraulic pressure signal a position of the blade without receiving information regarding the movement of the levers.

2. The lever-operated motor grader of claim 1, wherein the motor grader includes one or more of a plurality of auxiliary work tools.

3. The lever-operated motor grader of claim 2, wherein one of the auxiliary work tools includes a front blade that is lever-operated and coupled to a front blade hydraulic system and a front blade pressure sensor is coupled to the hydraulic system of the front blade and to the controller, the front blade pressure sensor outputting to the controller a signal corresponding to a pressure of the front blade hydraulic system, and wherein the controller is configured to determine an orientation of the front blade and to determine a utilization of the front blade using the signal from the front blade pressure sensor.

4. The lever-operated motor grader of claim 2, wherein one of the auxiliary work tools includes a snow wing that is lever-operated and coupled to a snow wing hydraulic system and a snow wing pressure sensor is coupled to the hydraulic system of the snow wing and to the controller, the snow wing pressure sensor outputting to the controller a signal corresponding to a pressure of the snow wing hydraulic system, and wherein the controller is configured to determine an orientation of the snow wing and to determine a utilization of the snow wing using the signal from the snow wing pressure sensor.

5. The lever-operated motor grader of claim 2, wherein one of the auxiliary work tools includes a ripper mechanism that is lever-operated and a rotary sensor is coupled to the ripper mechanism and to the controller, the rotary sensor outputting a signal to the controller corresponding to a position of the ripper mechanism, and wherein the controller is configured to determine an orientation of the ripper mechanism and to determine a utilization of the ripper mechanism using the signal from the rotary sensor.

6. The lever operated motor grader of claim 1, wherein the controller is configured to send the information regarding the application of the motor grader to an external site.

7. The lever operated motor grader of claim 1, wherein the controller receives the pressure information regarding the blade and further receives information regarding a speed of the motor grader and a location of the motor grader, and the information regarding the speed and the location are also used by the controller to determine the application of the motor grader.

8. The lever operated motor grader of claim 1, wherein the motor grader includes one or more of a plurality of auxiliary work tools and wherein the controller is configured to predict one or more motor grader applications including whether the motor grader is utilizing a snow wing, a front plow, or scarifying.

9. The lever operated motor grader of claim 8, wherein each of the one or more auxiliary work tools is activated via a hydraulics system and a pressure sensor or rotary sensor can be associated with each of the one or more auxiliary work tools and configured to send the sensed information to the controller and the controller is configured to determine the one or more motor grader application based on the received information.

10. The lever operated motor grader of claim 9, wherein the controller can send the information to an external location.

11. A method of identifying an application of a lever-operated motor grader, the method comprising:

an operator controlling a lever-operated blade by sending instructions using a lever to a hydraulic system controlling the lever-operated blade, wherein the operator-controlled levers are directly connected to the hydraulic system and not to a controller such that movement of the levers or other operator input is not recognized by the controller of the motor grader;

sending pressure information from a pressure sensor coupled to the hydraulic system of a lever-operated blade to the controller, wherein the pressure information includes a hydraulic pressure of a blade lift cylinder of the hydraulic system; and the controller determining an application of the motor grader based on the received blade lift cylinder hydraulic pressure information by determining from the hydraulic pressure information of the blade lift cylinder a position of the blade without receiving information regarding the movement of the levers.

12. The method of claim 11, further comprising determining whether one or more of a plurality of auxiliary work tools of the motor grader are being applied.

13. The method of claim 12, wherein one of the auxiliary work tools includes a front blade that is lever-operated and coupled to a front blade hydraulic system and a front blade pressure sensor is coupled to the hydraulic system of the front blade and to the controller, the front blade pressure sensor outputting to the controller a signal corresponding to a pressure of the front blade hydraulic system, and wherein the controller is configured to determine an orientation of the front blade and to determine a utilization of the front blade using the signal from the front blade pressure sensor.

14. The method of claim 12, wherein one of the auxiliary work tools includes a snow wing that is lever-operated and coupled to a snow wing hydraulic system and a snow wing pressure sensor is coupled to the hydraulic system of the snow wing and to the controller, the snow wing pressure sensor outputting to the controller a signal corresponding to a pressure of the snow wing hydraulic system, and wherein the controller is configured to determine an orientation of the snow wing and to determine a utilization of the snow wing using the signal from the snow wing pressure sensor.

15. The method of claim 12, wherein one of the auxiliary work tools includes a ripper mechanism that is lever-operated and a rotary sensor is coupled to the ripper mechanism and to the controller, the rotary sensor outputting to the controller a signal corresponding to a position of the ripper mechanism, and wherein the controller is configured to determine an orientation of the ripper mechanism and to determine a utilization of the ripper mechanism using the signal from the rotary sensor.

16. The method of claim 11, further comprising sending, via the controller, the information regarding the application of the motor grader to an external site.

17. The method of claim 16, wherein the controller receives the pressure information regarding the blade and further receives information regarding a speed of the motor grader and a location of the motor grader, and the information regarding the speed and the location are also used by the controller to determine the application of the motor grader.

18. The method of claim 17, wherein the motor grader includes one or more of a plurality of auxiliary work tools and wherein the controller is configured to predict one or more motor grader applications including whether the motor grader is utilizing a snow wing, a front plow, or scarifying.

19. The method of claim 18, wherein each of the one or more auxiliary work tools is activated via a hydraulics system and a pressure sensor or rotary sensor can be associated with each of the one or more auxiliary work tools and configured to send the sensed information to the controller and the controller is configured to determine the one or more motor grader application based on the received information.

20. The method of claim 19, further comprising sending, via the controller, the information regarding the application of the motor grader to an external site.

* * * * *